United States Patent [19]

Hasegawa et al.

[11] Patent Number: 4,996,127

[45] Date of Patent: Feb. 26, 1991

[54] TONER FOR DEVELOPING AN ELECTROSTATICALLY CHARGED IMAGE

[75] Inventors: Yukinobu Hasegawa; Hiroyoshi Shimomura, both of Hiratsuka; Koichi Murai, Fujisawa; Masatoshi Maruyama; Toyokichi Tange, both of Hiratsuka, all of Japan

[73] Assignee: Nippon Carbide Kogyo Kabushiki Kaisha, Tokyo, Japan

[21] Appl. No.: 261,829

[22] PCT Filed: Jan. 29, 1988

[86] PCT No.: PCT/JP88/00073

§ 371 Date: Sep. 23, 1988

§ 102(e) Date: Sep. 23, 1988

[87] PCT Pub. No.: WO88/05930

PCT Pub. Date: Aug. 11, 1988

[30] Foreign Application Priority Data

Jan. 29, 1987 [JP] Japan ..... 62-17378
May 15, 1987 [JP] Japan ..... 62-116797
May 15, 1987 [JP] Japan ..... 62-116798

[51] Int. Cl.[5] ..... G03G 9/00; G03G 5/00

[52] U.S. Cl. ..... 430/109; 430/137; 430/111

[58] Field of Search ..... 430/137, 109, 111

[56] References Cited

U.S. PATENT DOCUMENTS 4,659,506 4/1987 Nakamura et al. ..... 252/399

FOREIGN PATENT DOCUMENTS 238130 9/1987 European Pat. Off. ..... 430/109
8701828 3/1987 World Int. Prop. O. ..... 430/109

*Primary Examiner*—Marion C. McCamish
*Assistant Examiner*—Stephen C. Crossan
*Attorney, Agent, or Firm*—Sherman & Shalloway

[57] ABSTRACT

This invention provides a toner composed of associated particles of secondary particles comprising primary particles of a polymer having an acidic or basic polar group and particles of a coloring agent and optionally a charge controlling agent and a process for producing the toner. Preferably, the contacting portions among the secondary particles are at least partly melt-adhered by film formation. The toner of the invention has excellent advantages. It has a much higher resolution than conventional products. It has excellent chargeability and causes hardly any occurrence of fogging.

20 Claims, 2 Drawing Sheets

TONER FOR DEVELOPING AN ELECTROSTATICALLY CHARGED IMAGE

TECHNOLOGICAL FIELD

This invention relates to a toner for developing an electrostatically charged image in electrophotography, electrostatic recording, electrostatic printing, etc., and a process for its production.

BACKGROUND TECHNOLOGY

Toners generally used widely heretofore are produced by dry-blending a styrene/acrylate-type copolymer powder obtained by suspension polymerization with a coloring agent such as carbon black and optionally a charge controlling agent and/or a magnetic material, melt-kneading the mixture by an extruder or the like, and then pulverizing and classifying the kneaded mixture (see Japanese Laid-Open Patent Publication No. 23354/1976).

With the conventional toners obtained by the above melt-kneading/pulverizing method, controlling of the particle diameter of the toners is limited, and it is substantially difficult to produce toners having an average particle diameter of not more than 10 microns, especially not more than 8 microns, above all not more than 5 microns, in good yields. Moreover, it is difficult to avoid the defect that developers prepared from the toners have a low resolution and poor chargeability and fogging occurs.

It has also been proposed to produce a toner by copolymerizing monomers in the presence of a coloring agent. The product, however, still has the defect that it has insufficient chargeability and fogging occurs.

OBJECT OF THE INVENTION

It is an object of this invention to greatly eliminate the above defects of toners heretofore used widely, and to provide a toner at a lower price than the conventional toners by using a novel process for production.

DISCLOSURE OF THE INVENTION

The toner for developing an electrostatically charged image in accordance with this invention is a toner for developing an electrostatically charged image, composed of associated particles of secondary particles comprising primary particles of a polymer having an acidic or basic polar group (to be referred to as the "polymer having a polar group"), preferably a polymer having an acidic polar group, and particles of a coloring agent and optionally a charge controlling agent.

The primary particles of the polymer having a polar group as used in this invention are particles of a thermoplastic polymer having an average particle diameter of 0.05 to 0.5 micron, preferably 0.1 to 0.3 micron, and are preferably obtained by an emulsion polymerization method in general. The secondary particles constituting the associated particles which are the toner of the invention are particles resulting from aggregation of primary particles of the coloring agent having an average particle diameter of 0.01 to 0.5, preferably 0.03 to 0.1 micrometer, and the primary particles of the polymer having a polar group by bonding forces such as forces of an ionic bonding, a hydrogen bonding, a metal coordination bonding and a weak-acid weak base bonding, or Van der Waals force. Generally, the seconday particles have an average particle diameter of 0.5 to 5 microns, preferably 1 to 4 microns. FIG. 1 is a scanning electron micrograph (magnification 1,000X) showing one example of secondary particles formed in the toner producing process in the present invention.

The associated particles are irregularly-shaped particles formed by aggregation of the secondary particles. The associated particles have an average particle diameter of generally 3 to 25 microns, preferably 5 to 15 microns, most preferably 5 to 13 microns. FIG. 2 is a scanning electron micrograph (magnification 1000X) showing one example of the associated particles which are the toner of the invention.

In a preferred embodiment of the invention, there are used associated particles in which the contacting portions among the secondary particles constituting the associated particles are at least partly, preferably mostly, melt-adhered by film formation. FIG. 3 is a scanning electron micrograph (magnification 1000X) of associated particles of this invention in which at least a part of the contacting portions among the secondary particles are melt-adhered by film formation.

The associated particles which are the toner of this invention contains 20 to 99.9% by weight, preferably 30 to 98% by weight, most preferably 40 to 95% by weight, of the polymer having a polar group and 80 to 0.1% by weight, preferably 70 to 2% by weight, most preferably 60 to 5% by weight, of the coloring agent, based on the total weight of the polymer having a polar group and the coloring agent.

Preferred examples of the polymer having a polar group used in this invention include copolymers of styrenes, alkyl (meth)acrylates, and comonomers having an acidic or basic polar group (to be referred to as the "comonomers having a polar group").

Preferred examples of the copolymers are those containing (a) 90 to 20% by weight, preferably 80 to 30% by weight, based on the total weight of (a) and (b), of styrenes, (b) 10 to 80% by weight, preferably 20 to 70% by weight, based on the total weight of (a) and (b), of alkyl (meth)acrylates, and (c) 0.05 to 30 parts by weight, preferably 1 to 20 parts by weight, per 100 parts of (a) and (b) combined, of comonomers having a polar group. The copolymers may optionally contain polymerizable comonomers other than the monomers (a), (b) and (c) in proportions which do not impair the performance of the toner of the invention.

Examples of the styrenes (a) include styrene, o-methylstyrene, m-methylstyrene, p-methylstyrene, alphamethylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and p-chloromethylstyrene. Styrene is especially preferred.

Examples of the alkyl (meth)acrylates (b) include methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, methyl alpha-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate and stearyl methacrylate. Among them, esters of (meth)acrylic acid with aliphatic alcohols having 1 to 12 carbon atoms, preferably 3 to 8 carbon atoms, especially preferably 4 carbon atoms, are used preferably.

The monomers (c) having acidic polar groups may be, for example, (i) alpha,beta-ethylenically unsaturated compounds having a carboxyl group (—COOH) and (ii) alpha,beta-ethylenically unsaturated compounds having a sulfone group (—$SO_3H$).

Examples of the alpha,beta-ethylenically unsaturated compounds having the —COO group are acrylic acid, methacrylic acid, fumaric acid, maleic acid, itaconic acid, cinnamic acid, monobutyl maleate, monooctyl maleate, and metal salts, such as Na or Zn salts, of these acids.

Examples of the alpha,beta-ethylenically unsaturated compounds having the —$SO_3H$ group are sulfonated styrene, its sodium salt, allylsulfosuccinic acid, octyl allylsulfosuccinate and its sodium salt.

Examples of the comonomers (c) having a basic polar group are (i) (meth)acrylic acid esters of aliphatic alcohols having an amine group or a quaternary ammonium group and 1 to 12 carbon atoms, preferably 2 to 8 carbon atoms, especially preferably 2 carbon atoms, (ii) (meth)acrylamide, and (meth)acrylamide optionally mono- or di-substituted by an alkyl group having 1 to 18 carbon atoms on N, (iii) vinyl compounds substituted by a heterocyclic group containing N as a ring member, and (iv) N,N-diallyl-alkylamines and quaternary ammonium salts thereof. Of these, the (meth)acrylic acid esters of aliphatic alcohols having an amine group or a quaternary ammonium group (i) are preferred as the comonomers having a basic group.

Examples of the (meth)acrylic acid esters of aliphatic alcohols having an amine group or a quaternary ammonium group (i) are dimethylaminoethyl acrylate, dimethylaminoethyl methacrylate, diethylaminoethyl acrylate, diethylaminoethyl methacrylate, quaternary ammonium salts of the above four compounds, 3-dimethylaminophenyl acrylate, and 2-hydroxy-3-methacryloxypropyl trimethyl ammonium salt.

Examples of (meth)acrylamide or (meth)acrylamide optionally mono- or di-substituted by an alkyl group on N (ii) include acrylamide, N-butylacrylamide, N,N-dibutylacrylamide, piperidylacrylamide, methacrylamide, N-butylmethacrylamide, N,N-dimethylacrylamide and N-octadecylacrylamide.

Examples of the vinyl compounds substituted by a heterocyclic group containing N as a ring member (iii) are vinylpyridine, vinylpyrrolidone, vinyl-N-methylpyridinium chloride and vinyl-N-ethylpyridinium chloride.

Examples of the N,N-diallylalkylamines (iv) are N,N-diallylmethyl ammonium chloride and N,N-diallylethyl ammonium chloride.

The polymers having an acidic or basic polar group used in this invention can be preferably produced by an emulsion polymerization method. Surface-active agents that can be used in emulsion polymerization may be, for example, anionic surface-active agents, nonionic surface-active agents, protective colloids and cationic surface-active agents.

Examples of the anionic surface-active agents and the nonionic surface-active agents include a wide range of anionic surface-active agents, for example fatty acid salts such as sodium oleate and potassium oleate, alkylsulfuric acid ester salts such as sodium lauryl sulfate and ammonium lauryl sulfate, alkylarylsulfonic acid salts such as sodium alkylbenzenesulfonates and sodium alkylnapthalenesulfonates, dialkylsulfosuccinic acid salts, alkylphosphoric acid salts, and nonionic anionic surface-active agents resulting from addition of polyoxyalkylenes such as polyoxyethylene to these compounds; and a wide range of nonionic surface-active agents, for example polyoxyalkylene alkyl ethers such as polyoxyethylene lauryl ether and polyoxyethylene stearyl ether, polyoxyalkylene alkylphenol ethers such as polyoxyethylene octylphenol ether and polyoxyethylene nonylphenol ether, sorbitan fatty acid esters such as sorbitan monolaurate, sorbitan monostearate and sorbitan trioleate, polyoxyalkylene fatty acid esters such as polyoxyethylene monolaurate and polyoxyethylene monostearate, and glycerin fatty acid esters such as oleyl monoglyceride and stearyl monoglyceride. They may be used either singly or in combination. The amount of the surface-active agent used may be properly selected, and may be, for example, 0.05 to 10% by weight, preferably about 0.05 to 7% by weight, particularly 0.03 to 5% by weight, based on the total weight of the monomers used.

Examples of the protective colloids used include partially saponified polyvinyl alcohol, completely saponified polyvinyl alcohol, modified polyvinyl alcohol, cellulose derivatives and salts thereof such as hydroxyethyl cellulose, hydroxypropyl cellulose and carboxymethyl cellulose salts, and natural polysaccharides such as guar gum. They may be used either singly or in combination. The amount of the protective colloid used may be properly selected, and may be, for example, 0 to 10% by weight, preferably 0.05 to 5% by weight, especially preferably 0.05 to 2% by weight, based on the total weight of the monomers used.

Examples of the cationic surface-active agents include alkylamine salts such as laurylamine acetate, quaternary ammonium salts such as lauryl trimethyl ammonium chloride and alkylbenzyl methyl ammonium chloride, and polyoxyethylalkylamines. Examples of amphoteric surface-active agents are alkylbetains such as laurylbetain.

The amount of the cationic surface-active agent or the amphoteric surface-active agent may also properly selected, and may be, for example, 0 to 10% by weight, preferably 0.05 to 5% by weight, especially preferably 0.05 to 2% by weight, based on the total weight of the monomers used.

If the surface-active agent is used in an amount exceeding the preferred range, the resulting toner tends to have inferior moisture resistance. If it is too small, running property (stability of images in producing many copies) tends to be reduced.

Examples of catalysts used in aqueous emulsion copolymerization include persulfates such as sodium persulfate, potassium persulfate and ammonium persulfate, organic peroxides such as tertiary butyl hydroperoxide, cumene hydroperoxide and p-menthane hydroperoxide, and hydrogen peroxide. They may be used either singly or in combination. The amount of the catalyst may be properly selected, and may be, for example, about 0.05 to about 1% by weight, preferably about 0.1 to about 0.7% by weight, particularly about 0.1 to about 0.5% by weight.

If desired, a reducing agent may be used jointly in the aqueous emulsion polymerization. Examples of the reducing agent are reducing organic compounds such as ascorbic acid, tartaric acid, citric acid and glucose, sodium thiosulfate, sodium sulfite, sodium bisulfite, and sodium meta-bisulfite. The amount of the reducing agent used may be properly selected, and is, for example, about 0.05 to about 1% by weight, based on the total weight of the monomers used.

In carrying out the aqueous emulsion copolymerization reaction, all the amount of a predetermined surface-active agent may be added to the reaction system. It is also possible to add part of the surface-active agent to the reaction system, start the reaction and add the remainder during the reaction either continuously or portionwise at intervals, and this procedure is preferred. The monomers and as desired, other modifying comonomers may be added at a time, portionwise, or continuously. To control the reaction, it is preferred to add them continuously.

In addition to the surface-active agents and catalysts described above, a pH adjusting agent, a polymerization degree adjusting agent, a defoamer, etc. may properly be added during the emulsion polymerization.

The polymer having a polar group used in this invention has a glass transition temperature of −90° to 100° C., preferably −30° to 80° C., most preferably −10° to 60° C., and a gellation degree, in terms of the amount of an insoluble portion on Soxhlet extraction under acetone reflux, of 0.0 to 99.9% by weight, preferably 1 to 30% by weight. If its glass transition is too high beyond 100° C., the resulting toner undesirably tends to have reduced low-temperature fixability. If it is too low below −90° C., the flowability of the toner particles undesirably tends to be deteriorated. On the other hand, if its gellation degree is too high beyond 50% by weight, the low-temperature fixability of the resulting toner undesirably tends to be reduced.

The term "coloring agent" used in this specification means a coloring additive which gives to the developer a color necessary as a developer for an electrostatically charged image. Accordingly, if additives which impart properties (e.g., magnetism or charge controlling property) other than those of the coloring agent to the developer, for example, if charge controlling agents such as a magnetic material (e.g., magnetite) or a nigrosine dye impart the desired coloring property to the developer, these additives are also included within the "coloring agent".

Inorganic pigments, organic pigments and organic dyes, preferably the inorganic pigments or organic pigments may be used as the coloring agent in accordance with this invention. The inorganic pigments preferably include (a) metallic powder-type pigments,
(b) metal oxide-type pigments,
(c) carbon-type pigments,
(d) sulfide-type pigments,
(e) chromate salt-type pigments, and
(f) ferrocyanide salt-type pigments.

Examples of the metal powder-type pigments (a) are zinc, iron and copper powders.

Examples of the metal oxide-type pigments (b) are magnetite, ferrite, red iron oxide, titanium oxide, zinc flower, silica, chromium oxide, ultramarine, cobalt blue, Cerulean blue, mineral violet, and trilead tetroxide.

Examples of the carbon-type pigments (c) are carbon black, thermatomic carbon, lamp black and furnace black.

Examples of the sulfide-type pigments (d) are zinc sulfide, cadmium red, selenium red, mercury sulfide and cadmium yellow.

Examples of the chromate-type pigments (e) are molybdenum red, barium yellow, strontium yellow and chrome yellow.

Milori Blue is an example of the ferrocyanide compound-type pigments (f).

Examples of the organic pigments are shown below.

(a) Azoic pigments

Hansa Yellow G, benzidine yellow, benzidine orange, permanent red 4R, pyrazolone red, Lithol Red, brilliant scarlet G and Bon Maroon Light.

(b) Acid dye-type pigments and basic dye-type pigments

Products obtained by precipitating such dyes as orange II, acid orange R, eoxine, quinoline yellow, tartrazine yellow, acid green, peacock blue and alkali blue with precipitating agents, and products obtained by precipitating such dyes as Rhodamine, magenta, malachite green, methyl violet and victoria blue with tannic acid, tartar emetic, PTA, PMA, PTMA, etc.

(c) Mordant dye-type pigments

Metal salts of hydroxyanthraquinones, and alizarin murder lake.

(d) Phthalocyanine pigments

Phthalocyanine blue and copper phthalocyanine sulfonate (e) Quinacridone-type pigments and dioxane-type pigments Quinacridone red, quinacridone violet and carbazoledioxazine violet.

(f) Others

Organic fluorescent pigments and aniline black.

Nigrosine dyes and aniline dyes are used as the organic dyes mentioned above.

As stated above, the toner of this invention, as required, may contain a charge controlling agent or a magnetic material, for example. Examples of the charge controlling agent are those for dealing with positive charges, for example electron-donating dyes of the nigrosine type, metal salts of naphthenic acid, metal salts of higher fatty acids, alkoxylated amines, quaternary ammonium salts, alkylamides, chelates, pigments and fluorine treatment activating agents, and those for dealing with negative charges, for example electron accepting organic complexes, chlorinated paraffin, chlorinated polyesters, polyesters having an excess of acid groups, and a sulfonylamine of copper phthalocyanine.

For the purpose of improving fixability, the toner of the invention may contain additives. Examples of the fixability improving additives include olefinic resins (such as low-molecular-weight polyethylene, low-molecular-weight polypropylene, polyethylene oxide and polytetrafluoroethylene), epoxy resins, polyester resins, styrene/butadiene copolymer (monomer ratio 5-30:95-70), olefin copolymers (such as ethylene/acrylic acid copolymer, ethylene/acrylate ester copolymers, ethylene methacrylic acid copolymer, ethylene methacrylate ester copolymers, ethylene/vinyl chloride copolymer, ethylene/vinyl acetate copolymer, and ionomer resins), polyvinyl pyrrolidone, methyl vinyl ether/maleic anhydride copolymer, maleic acid-modified phenolic resins and phenol-modified terpene resins. The olefinic resins are preferred. These resins are used preferably as an aqueous emulsion.

As required, the toner of this invention may be used together with additives such as a fluidizing agent. Fine powders of hydrophobic silica, titanium dioxide and aluminum oxide may be cited as examples of the fluidizing agent. The fluidizing agent may be used in an amount of 0.01 to 5 parts by weight, preferably 0.1 to 1 part by weight, per 100 parts by weight of the toner.

For the purpose of improving moisture resistance, the toner of this invention may be surface-treated with a silane coupling agent and a titanium coupling agent.

These coupling agents may be used singly or in combination of two or more.

A preferred process for producing the toner of this invention will be described below. A required amount of the coloring agent powder and optionally the charge controlling agent are mixed with an emulsion of the polymer having an acidic or basic polar group obtained by emulsion polymerization to disperse them finely. When the mixture is further stirred for 0.5 to 4 hours, preferably 1 to 3 hours, primary particles of the polymer having a polar group and the coloring agent particles gradually aggregate and grow to secondary particles having an average particle diameter of 0.5 to 5 microns as shown in the photograph of FIG. 1. When the resulting dispersion is further stirred for 0.5 to 3 hours, preferably 1 to 2 hours, the secondary particles further aggregate and grow to associated particles having an average particle diameter of 5 to 25 microns as shown in the photograph of FIG. 2. According to the most preferred process of producing the toner of this invention, when the resulting dispersion is further stirred for 1 to 6 hours, preferably 3 to 4 hours, at the glass transition temperature of the polymer having a polar group to a temperature 65° C. higher than the glass transition temperature, associated particles in which the contacting portions among the secondary particles are at least partly melt-adhered by film formation, as shown in the photograph of FIG. 3. Since the secondary particles are melt-adhered to each other by film formation, these associated particles do not substantially undergo disintegration during storage, transportation and production of a developer, and are especially suitable as a developer for electrostatically charged images.

A developer is prepared by mixing the toner of this invention with a carrier such as iron and glass beads. When the toner itself already contains ferrite as the coloring agent, the ferrite also acts as a carrier. In this case, the resulting developer may be used directly. An iron powder having negative triboelectric charging property as a result of coating with a resin, preferably a fluorine-type resin is particularly suitable as the carrier.

EFFECT OF THE INVENTION

The toner of this invention has a relatively narrow particle size distribution and a relatively small average particle diameter. Hence, when it is formed into a developing agent for electrostatically charged images, it exhibits excellent effects in that its resolution is much improved over conventional products, its chargeability is excellent, and there is hardly any occurrence of fogging. Furthermore, the process for producing it is simplified as compared with the prior art because it does not require pulverization and classification and does not necessarily require coagulating agents such as magnesium sulfate. Furthermore, since the yield of the required toner particles is high, the process has excellent economy.

BRIEF DESCRIPTION OF THE DRAWINGS

FIG. 2 is an electron micrograph showing the structure of the associated particles of the toner of the invention.

Figure 1:
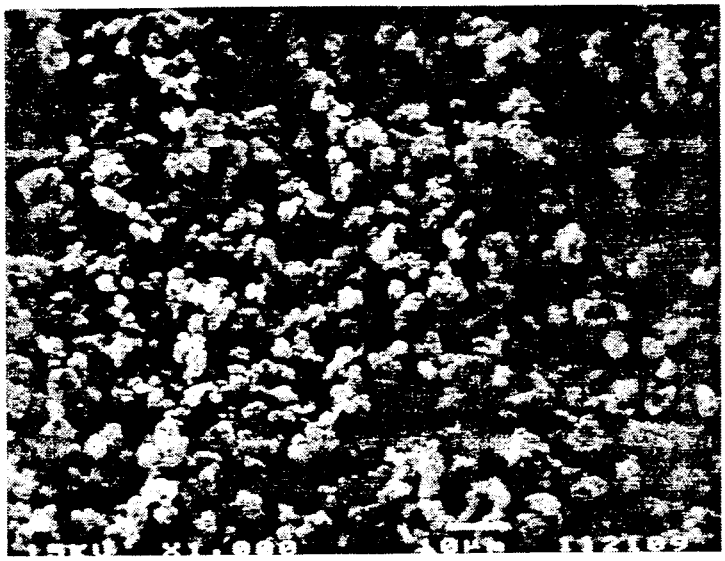
FIG. 1 is an electron micrograph showing the structure of primary particles during the production of the toner of this invention.
Figure 3:
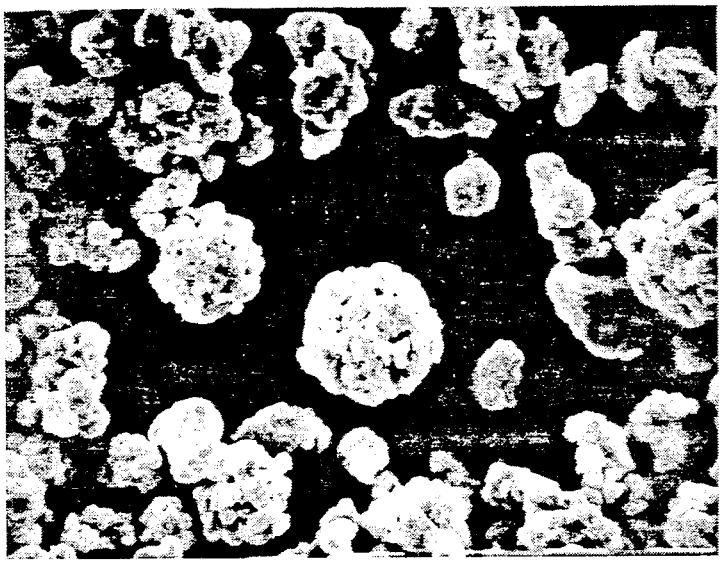
FIG. 3 is an electron micrograph showing the structure of the associated particles in which the contacting portions among the secondary particles are at least partly melt-adhered by film formation.

The following examples illustrate the present invention specifically. Unless otherwise specified, all amounts are expressed by weight.

EXAMPLE 1

Preparation of a polymer containing an acid polar group

| | |
|---|---|
| Styrene monomer (ST) | 60 parts |
| Butyl acrylate (BA) | 40 parts |
| Acrylic acid (AA) | 8 parts |

A mixture of the above monomers was added to a mixture of the following ingredients.

| | |
|---|---|
| Water | 100 parts |
| Nonionic emulsifier (Emulgen 950) | 1 part |
| Anionic emulsifier (Neogen R) | 1.5 parts |
| Potassium persulfate | 0.5 part |

The resulting mixture was stirred at 70° C. for 8 hours to obtain an emulsion of a resin having an acid polar group. The solids concentration of the emulsion was 50%.

Preparation of a toner (1)

| | |
|---|---|
| Emulsion of a resin containing an acid polar group | 120 parts |
| Magnetite | 40 parts |
| Nigrosine dye (Bontron N-04) | 5 parts |
| Carbon black (Dia Black #100) | 5 parts |
| Water | 380 parts |

A mixture of the above ingredients was maintained at about 30° C. for 2 hours while it was dispersed and stirred by means of a slusher. It was then heated to 70° C. with stirring and maintained at this temperature for 3 hours. In the meantime, microscopic observation led to the determination that a complex of resin particles and magnetite particles grew to a size of about 10 microns. The mixture was cooled, and the resulting liquid dispersion was subjected to Buchner filtration, washed with water, and dried in vacuum at 50° C. for 10 hours.

To 100 parts by weight of the toner was added 0.5 part by weight of silica (Aerosil R972 manufactured by Japan Aerosil Co., Ltd.) as a fluidizing agent, and they were mixed to form a test developer.

The polymer used in this toner had a Tg of 45° C., a gellation degree of 5% and a softening point of 148° C. The toner had an average particle diameter of 12 microns.

The developer was charged into a commercial copying machine (NP-270Z produced by Canon Co., Ltd.), and copying was carried out. Copied images having a high density and reduced fog were obtained. The results are shown in Table 2.

EXAMPLES 2-7

The monomer compositions shown in Table 1 were used, and subjected to the same operation as in Example 1. The results are shown in Table 2. The abbreviations used in Table 1 have the following meanings.

MAA: methacrylic acid

MBM: monobutyl maleate

BQA: 2-hydroxypropyl-N,N,N-trimethyl ammonium chloride acrylate
DMAA: dimethylaminoethyl acrylate
LMA: lauryl methacrylate
VP: vinylpyridine
DMPC: N,N-diallylmethyl ammonium chloride

EXAMPLE 8

An emulsion of a resin containing an acid polar group was prepared as in Example 1, and a toner was prepared by the following operation.

Preparation of a toner (2)

| | |
|---|---|
| Emulsion of a resin containing an acid polar group | 184 parts |
| Chrome dye (Bontron E-81) | 1 part |
| Carbon black (Regal 330R) | 7 parts |
| Water | 307 parts |

A mixture of the above ingredients were worked up in the same way as in Example 1 to prepare a test toner. The polymer had a Tg of 43° C., a gellation degree of 590 and a softening point of 147° C. The toner had an average particle diameter of 10.5 micrometers.

The toner was charged into a commercial copying machine (Leodry BD-4140 made by Toshiba Co., Ltd.), and copying was carried out. Copied images having a high density and reduced fog were obtained. The results are shown in Table 2.

EXAMPLES 9-11

The same operation as in Example 8 was repeated using the monomer compositions shown in Table 1. The results are shown in Table 2.

EXAMPLE 12

When during the reaction of forming the associated particles in Example 1, the toner-forming composition was heated to 60° C. and maintained at this temperature for 2 hours instead of maintaining it at 70° C. for 2 hours, the growth of particles was controlled, and a toner having an average particle diameter of 5 micrometers was obtained in a yield of 60%. When a copying test was carried out using this toner, images having a very good resolution, a high density and reduced fog were obtained.

COMPARATIVE EXAMPLE 1

When an emulsion of a resin obtained by polymerization using the resin monomer composition shown in Example 1 but without adding AA (a monomer having an acid polar group) as shown in Table 1, the associated particles did not grow, and a test toner could not be obtained.

COMPARATIVE EXAMPLE 2

The resin emulsion obtained in Example 1 was dried by a spray dryer (Mobile Minor made by Ashizawa Niroatomizer) under the following conditions.

Inlet temperature: 120° C.
Outlet temperature: 90° C.
Feed rate: 1.5 liters/min.
Atomizer: operated at $3\times10^4$ rpm.

Sixty parts of the resulting resin, 40 parts of magnetite, 5 parts of a nigrosine dye (Bontron N-04) and 5 parts of carbon black (Dia Black #100) were melt-kneaded and pulverized to give a toner having an average particle diameter of 5 micrometers. The yield at this time was 35%.

To 100 parts by weight of the resulting toner, 0.5 part by weight of silica (R-972 produced by Japan Aerosil Co., Ltd.), and they were mixed to form a test developer.

This developer had very poor flowability. When this developer was subjected to the same copying test as in Example 1, images having much fogging were obtained.

COMPARATIVE EXAMPLE 3

A resin having the composition shown in Table 1 was obtained by the same operation as in Comparative Example 2. The resin was compounded as in Comparative Example 2 and melt-kneaded and pulverized to give a toner having an average particle diameter of 12.0 micrometers in a yield of 55%. The same copying test was carried out using the resulting toner. The results are shown in Table 2.

Method of evaluating the resolution of a copied image

The test pattern AR-4 of Data Quest Co., Ltd. was copied. The number of lines per mm in the copied test pattern was determined by visual observation, and made a rating of resolution. By this evaluating method, with the resin composition shown in Table 1, at least 6.3 lines can be determined to be a good resolution, and not more than 3.6 lines, a poor resolution.

Method of evaluating fogging of a copied image

Using a reflectometer (CM-53P made by Murakami Color Laboratory Co., Ltd.), the reflectance of white paper before copying and the reflectance of the non-character portion of the paper after copying were compared at a light angle of 45°. The ratio of the reflectance is defined as a fog density (%). A fog density of not more than 0.7 can be determined to be good, and a fog density of at least 1.0, to be poor.

TABLE 1

| | Resin emulsion | | | | | Polymer | |
|---|---|---|---|---|---|---|---|
| | ST | (Meth)-acrylate | | Acidic or basic monomer | | Tg (°C.) | Gellation degree (%) |
| Example | | | | | | | |
| 1 | 60 | BA | 40 | AA | 8 | 45 | 5 |
| 2 | 40 | 2EHA | 60 | MAA | 8 | 12 | 5 |
| 3 | 40 | 2EHA | 60 | MBM | 5 | 5 | 2 |
| 4 | 60 | BA | 40 | BQA | 5 | 40 | 20 |
| 5 | 40 | 2EHA | 60 | DMAA | 2 | 8 | 15 |
| 6 | 40 | 2EHA | 60 | VP | 2 | 10 | 13 |
| 7 | 70 | LMA | 30 | DMPC | 5 | 15 | 3 |
| 8 | 60 | BA | 40 | AA | 8 | 43 | 5 |
| 9 | 40 | 2EHA | 60 | MAA | 8 | 12 | 5 |
| 10 | 60 | BA | 40 | BQA | 5 | 40 | 20 |
| 11 | 70 | LMA | 30 | DMPC | 5 | 15 | 3 |
| 12 | 60 | BA | 40 | AA | 8 | 45 | 5 |
| Comp. Example | | | | | | | |
| 1 | 60 | BA | 40 | (none) | | — | — |
| 2 | 60 | BA | 40 | AA | 8 | 45 | 5 |
| 3 | 60 | BA | 40 | AA | 8 | 45 | 5 |

TABLE 2

| Example | Average particle diameter of the toner (micrometer) | Resolution (lines) | Fog density (%) |
|---|---|---|---|
| 1 | 12.0 | 8.0 | 0.4 |
| 2 | 11.5 | 8.0 | 0.4 |
| 3 | 13.0 | 6.3 | 0.3 |

TABLE 2-continued

| Example | Average particle diameter of the toner (micrometer) | Resolution (lines) | Fog density (%) |
|---|---|---|---|
| 4 | 9.5 | 8.0 | 0.5 |
| 5 | 12.5 | 7.1 | 0.4 |
| 6 | 12.5 | 6.3 | 0.3 |
| 7 | 10.5 | 6.3 | 0.4 |
| 8 | 10.5 | 7.1 | 0.4 |
| 9 | 11.0 | 6.3 | 0.3 |
| 10 | 9.0 | 7.1 | 0.5 |
| 11 | 9.5 | 7.1 | 0.5 |
| 12 | 5.0 | 25 | 0.6 |
| Comp. Example | | | |
| 1 | — | — | |
| 2 | 5.0 | 4.5 | 3.2 |
| 3 | 12.0 | 3.6 | 1.5 |

EXAMPLE 13

Preparation of a polymer having an acid polar group

| | |
|---|---|
| Styrene monomer (AT) | 75 parts |
| Butyl acrylate (BA) | 35 parts |
| Acrylic acid (AA) | 3 parts |

A mixture of the above monomer was added to a mixture of the following ingredients.

| | |
|---|---|
| Water | 100 parts |
| Nonionic emulsifier (Emulgen 950) | 1 part |
| Anionic emulsifier (Neogen R) | 0.1 part |
| Potassium persulfate | 0.5 part |

The resulting mixture was polymerized at 70° C. for 8 hours with stirring to give an emulsion of a resin having an acid polar group with a solids content of 50%.

Preparation of a toner (1)

| | |
|---|---|
| Emulsion of the resin having an acid polar group | 120 parts |
| Magnetite | 40 parts |
| Nigrosine dye (Bontron N-04) | 5 parts |
| Carbon black (Dia Black #100) | 5 parts |
| Water | 380 parts |
| Wax emulsion (HYTEC E-4B) (effective component 40%) | 20 parts |

A mixture of the above ingredients was maintained at about 30° C. for 2 hours while dispersed and stirred by a slusher.

Observation under a scanning electron microscope during this time showed that the primary particles had a size of 0.3 micron, and the primary particles of the coloring agent had a size of 0.04 to 0.08 micron, and the aggregated secondary particles had a size of about 2 microns. Thereafter, the mixture was maintained at 70° C. for 3 hours with stirring. Microscopic observation during this time led to the determination that a complex of the resin particles and the magnetite particles grew to a size of about 10 microns. The mixture was cooled, and the resulting liquid dispersion was subjected to Buchner filtration, washed with water, and dried in vacuum at 50° C. for 10 hours.

Five parts of a 10% ethanol solution of a silane coupling agent (A-143 produced by Nippon Unicar Co.) was sprayed onto 100 parts of the resulting particles, and surface coupling was effected at 40° C. for 50 hours to form a test toner.

The polymer used in the toner had a Tg of 55° C., a gellation degree of 15% and a softening point of 135° C. The toner had an average particle diameter of 13 microns.

The developer was charged into a commercial copying machine (NP-270Z made by Canon Co., Ltd.), and copying was carried out. Copied images having a high density and reduced fog (fog density 0.0) were obtained.

The fixability of this toner was tested by the following method, and the fixation ratio was as good as 95%.

The moisture resistance of the toner in an environment kept at room temperature and 85% humidity was tested by the following method. The fog density was as low as 0.1%, and good results were obtained.

The chargeability of this toner was excellent, and the distribution of the amount of charge was very narrow.

Evaluation of fixability

The test pattern AR-4 of Data Quest Co., Ltd. was copied, and the solid portion was rubbed with a sanded rubber eraser through 5 reciprocations. The ratio of the reflectance of the solid portion after rubbing and that before rubbing was determined by a reflectometer, and defined as the fixation ratio. The reflectometer was CM-53P made by Murakami Color Laboratory Co., Ltd.

Evaluation of moisture resistance

The test was carried out after the copying test in an environment kept at room temperature and 85% for 3 days. The fog density of the non-character portion of the test pattern was measured by using the above reflectometer. The reflectance of white paper before copying and that of the non-character portion after copying were compared, and the ratio of the reflectances was defined as a fog density.

We claim:

1. A toner for developing an electrostatically charged image, composed of associated particles of secondary particles comprising primary particles of a polymer having an acidic or basic polar group and particles of a coloring agent and optionally a charge controlling agent.

2. The toner set forth in claim 1 in which the contacting portions among the secondary particles are at least partly melt-adhered by film formation.

3. The toner as set forth in claim 1 wherein said primary particles comprise a thermoplastic polymer having an average particle diameter of 0.05 to 0.5 micron, said particles of coloring agent have an average particle diameter of 0.01 to 0.5 micron, said secondary particles have an average particle diameter of 0.5 to 5 microns and said associated particles have an average particle diameter of 3 to 25 microns.

4. The toner as set forth in claim 1 wherein said primary particles comprise a thermoplastic polymer having an average particle diameter of 0.1 to 0.3 micron, said particles of coloring agent have an average particle diameter of 0.03 to 0.1 micron, said secondary particles have an average particle diameter of 1 to 4 microns and said associated particles have an average particle diameter of 5 to 15 microns.

5. The toner as set forth in claim 1 wherein said associated particles contain 20 to 99.9% by weight of polymer having the acidic or basic polar group and 80 to 0.1% by weight of the coloring agent, based on the total weight of the polymer having the polar group and the coloring agent.

6. The toner as set forth in claim 1 wherein said associated particles contain 30 to 98% by weight of polymer having the acidic or basic polar group and 70 to 2% by weight of the coloring agent, based on the total weight of the polymer having the polar group and the coloring agent.

7. The toner as set forth in claim 1 wherein said associated particles contain 40 to 95% by weight of polymer having the acidic or basic polar group and 60 to 5% by weight of the coloring agent, based on the total weight of the polymer having the polar group and the coloring agent.

8. The toner as set forth in claim 1 wherein said polymer having an acidic or basic polar group contains (a) 90 to 20% by weight, based on the total weight of (a) and (b) of styrene monomer, (b) 10 to 80% by weight, based on the total weight of (a) and (b) of alkyl(meth)acrylates and (c) 0.05 to 30 parts by weight, per 100 parts by weight of (a) and (b) combined, of comonomer having an acidic or basic polar group.

9. The toner as set forth in claim 1 wherein said polymer having an acidic or basic polar group contains (a) 80 to 30% by weight, based on the total weight of (a) and (b) of styrene monomer, (b) 20 to 70% by weight, based on the total weight of (a) and (b) of alkyl(meth)acrylates and (c) 1 to 20 parts by weight, per 100 parts by weight of (a) and (b) combined, of comonomer having an acidic or basic polar group.

10. The toner as set forth in claim 1 wherein said polymer having an acidic or basic polar group has a glass transition temperature of from −90° to 100° C. and a gelation degree, in terms of the amount of an insoluble portion of Soxhlet extraction under acetone reflux, of 0.0 to 99.9% by weight.

11. The toner as set forth in claim 1 wherein said polymer having an acidic or basic polar group has a glass transition temperature of from −30° to 80° C. and a gelation degree, in terms of the amount of an insoluble portion of Soxhlet extraction under acetone reflux, of 1 to 30% by weight.

12. The toner as set forth in claim 1 further comprising from about 0.01 to 5 parts by weight, per 100 parts by weight of the toner, of a fluidizing agent.

13. The toner set forth in claim 1 wherein the associated particles have an average particle diameter of from 3 to 25 microns.

14. The toner of claim 1 in which the coloring agent comprises particles of a coloring additive selected from the group consisting of inorganic pigments and organic pigments.

15. The toner of claim 1 which further comprises a charge controlling agent.

16. The toner of claim 1 which further comprises a fixability improving additive.

17. The toner of claim 1 which has been surface-treated with a silane coupling agent or a titanium coupling agent to improve moisture resistance.

18. A developer for developing an electrostatically charged image comprising (1) a toner for developing an electrostatically charged image, composed of associated particles of secondary particles comprising primary particles of a polymer having an acidic or basic polar group and particles of a coloring agent and optionally a charge controlling agent, and (2) carrier.

19. The developer according to claim 18 wherein the associated particles have an average particle diameter of from 3 to 25 microns.

20. The developer according to claim 18 wherein said carrier comprises iron beads or glass beads.

* * * * *